US011654315B2

(12) United States Patent
Reitz

(10) Patent No.: US 11,654,315 B2
(45) Date of Patent: May 23, 2023

(54) DEVICE FOR DISCHARGING EXTINGUISHING AGENT

(71) Applicant: Bender GmbH & Co. KG, Gruenberg (DE)

(72) Inventor: Julian Reitz, Gruenberg (DE)

(73) Assignee: BENDER GMBH & CO. KG, Gruenberg (DE)

( * ) Notice: Subject to any disclaimer, the term of this patent is extended or adjusted under 35 U.S.C. 154(b) by 93 days.

(21) Appl. No.: 17/318,088

(22) Filed: May 12, 2021

(65) Prior Publication Data

US 2021/0353987 A1 Nov. 18, 2021

(30) Foreign Application Priority Data

May 15, 2020 (DE) ..... 10 2020 113 194.1

(51) Int. Cl.
*A62C 3/16* (2006.01)
*A62C 37/36* (2006.01)
*A62C 3/02* (2006.01)

(52) U.S. Cl.
CPC ..... *A62C 3/16* (2013.01); *A62C 3/0292* (2013.01); *A62C 37/04* (2013.01)

(58) Field of Classification Search
CPC ..... A62C 3/16; A62C 3/0292; A62C 17/00; A62C 31/02; A62C 31/03; A62C 31/005; B05B 1/12; B05B 1/30; B05B 1/3026; B05B 9/01; B05B 9/03; B05B 11/0005; B05B 11/0029
USPC ..... 169/54
See application file for complete search history.

(56) References Cited

U.S. PATENT DOCUMENTS 6,321,037 B1 * 11/2001 Reid ..... A01M 21/04 392/475
2019/0336988 A1 * 11/2019 Daudish ..... F24H 9/1818

FOREIGN PATENT DOCUMENTS

| | | | | |
|---|---|---|---|---|
| CN | 202105353 U | | 1/2012 | |
| CN | 202915575 U | | 5/2013 | |
| CN | 203025245 U | | 6/2013 | |
| CN | 103487629 A | | 1/2014 | |
| CN | 104704539 A | | 6/2015 | |
| CN | 204469078 | * | 7/2015 | ..... A62C 31/00 |

(Continued)

*Primary Examiner* — Christopher R Dandridge
(74) *Attorney, Agent, or Firm* — Dickinson Wright PLLC; Andrew D. Dorisio

(57) ABSTRACT

An extinguishing-agent discharge device includes a casing having a guide channel for an extinguishing agent, a metallic handle, a hose connection, an adjustment means for regulating an extinguishing-agent supply using a manual control unit and a discharge nozzle. A measuring-current transformer generates a current signal proportional to the electric current flowing in the extinguishing agent; an insulator section divides the casing into a discharge area having the discharge nozzle and an inlet area having the manual control unit, the measuring-current transformer disposed in the insulator section; a first electrode disposed in the discharge area in the extinguishing-agent flow and serves for detecting an extinguishing-agent potential; a second electrode disposed at the handle for detecting a ground potential in the inlet area; and a controller for evaluating the current signal for a potential difference occurring between the extinguishing-agent and ground and having a drive element acting on the adjustment means.

5 Claims, 2 Drawing Sheets

(56) References Cited

FOREIGN PATENT DOCUMENTS

Figure 1:
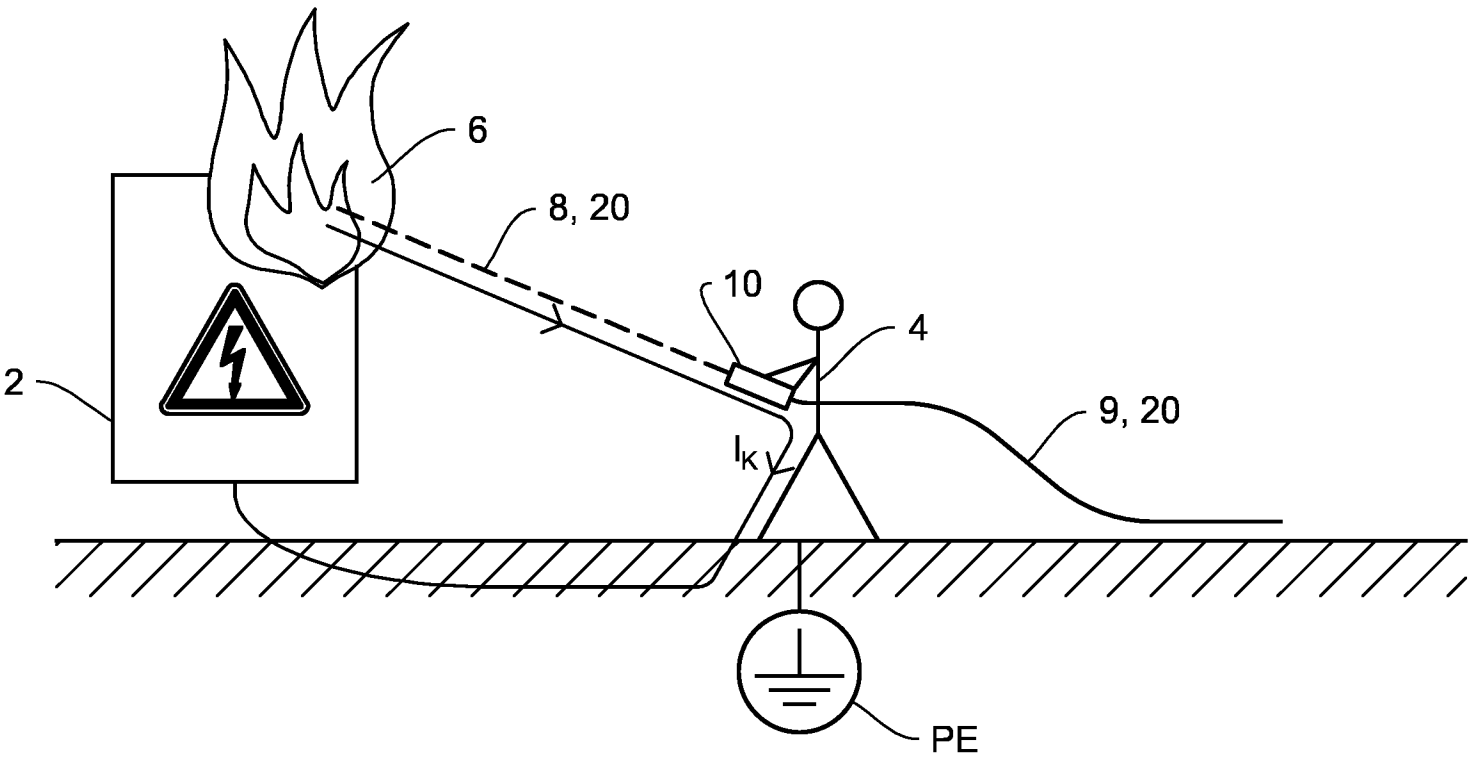

| | | | |
|---|---|---|---|
| CN | 204469078 | U | 7/2015 |
| DE | 29811314 | U1 | 1/1999 |
| DE | 102010048080 | A1 | 4/2012 |
| DE | 102012016007 | A1 | 2/2014 |
| DE | 102015210199 | A1 | 12/2016 |

* cited by examiner

DEVICE FOR DISCHARGING EXTINGUISHING AGENT

This application claims the benefit of German Patent Application No. 10 2020 113 194.1 filed on May 15, 2020.

TECHNICAL FIELD

The invention relates to an extinguishing-agent discharge device consisting of a casing having a guide channel through which an extinguishing agent flows, a metallic handle, a hose connection means, an adjustment means for regulating an extinguishing-agent supply using a manual control unit and a discharge nozzle.

BACKGROUND

When fighting fires of electrically live electric installations and systems using an extinguishing agent, life-threatening situations can arise for the acting person caused by electric shock if the acting person is within the safety zone.

For producing the extinguishing effect, the extinguishing agent is discharged in a spray jet or a pressurized full jet onto the seat of fire by means of an extinguishing-agent discharge device, such as a fog nozzle having an adapter nozzle.

Extinguishing-agent discharge devices known from the state of the art comprise a casing forming a guide channel (fog nozzle) through which extinguishing agent flows. As commonly known, these extinguishing-agent discharge devices comprise a metallic handle, a hose connection means at the input and an adjustment means for regulating an extinguishing-agent supply having a manual control unit and a discharge nozzle at the outlet for the targeted discharge of the extinguishing-agent jet.

The extinguishing agents used can have electric conductivity. In particular, if water is used as the extinguishing agent, it is typically taken from the local mains or rainwater cisterns. Hence, it is not chemically pure and has a measurable electric conductivity.

If a certain safety distance is not maintained when fighting fire with an electrically conductive extinguishing agent, a continuous, electrically conductive connection between the electrically live burning object and the extinguishing-agent discharge device can arise because no droplets are formed in the water jet.

A person who touches the extinguishing-agent discharge device at the metallic handle with their hands runs the risk of being subjected to voltage which can cause life-threatening currents to pass through the body (body currents).

Fighting fires in the field of electromobility poses a particular threat as motor vehicles with high-voltage electric drives may not at first glance be identifiable as vehicles having dangerous vehicle voltage in the event of an accident.

According to standard firefighting procedures, specific safety distances are to be maintained by relief units when fighting fires of electric installations. These safety distances can only be maintained, however, when the threat has been assessed correctly.

Different safety protocols for relief units are known for fighting fires in electric vehicles. For instance, insulated gloves are to be worn and a measuring device carried in order to test whether the electric vehicle is live. Moreover, protective suits and insulated mats have been proposed.

From an electric point of view, these measures are insufficient when firefighting, as on the one hand an arbitrary number of metallic points of the burning object, e.g., the deformed electric vehicle, would need to be measured for live voltage, and on the other hand there is also the question of reference potential for the board network realized as an ungrounded power supply system when it comes to electric vehicles.

The use of insulation mats also appears questionable since they give a false sense of security and can lose their effectiveness upon becoming wet (with extinguishing agent).

SUMMARY

The object of the invention at hand is therefore to increase the electric safety for the acting person by means of an extinguishing-agent discharge device when fighting fires.

This object is attained by the extinguishing-agent discharge device according to the invention comprising the following in connection with the features in the preamble of claim 1: a measuring-current transformer which encloses the extinguishing agent flowing in the guide channel and generates a current signal which is proportional to the electric current flowing in the extinguishing agent; an insulator section which divides the casing in the longitudinal direction of the guide channel into a discharge area having the discharge nozzle and an inlet area having the manual control unit, the measuring-current transformer being disposed in the insulator section; a first electrode which is disposed in the discharge area in the extinguishing-agent flow and serves for detecting an extinguishing-agent potential; a second electrode which is disposed at the metallic handle for detecting a ground potential in the inlet area; and a control device having evaluation electronics for evaluating the current signal and for evaluating a potential difference occurring between the extinguishing-agent potential and ground potential and having an electromechanical drive element which is controlled by the evaluation electronics and acts on the adjustment means.

The fundamental idea of the invention at hand rests upon detecting and evaluating an electric current flowing in the extinguishing agent and upon measuring and evaluating a potential difference between the electric potential of the extinguishing agent and ground potential, with the aim to prevent a dangerous body current.

For detecting the electric current flowing in the extinguishing agent, the extinguishing-agent discharge device comprises a measuring-current transformer which encloses the extinguishing agent flowing in the guide channel and detects the electric current, which flows in the extinguishing agent, as a primary current. At the secondary side, the measuring-current transformer generates a current signal which is proportional to the detected electric current.

The extinguishing-agent discharge device further comprises an insulator section which divides the casing in the longitudinal direction of the guide channel into a discharge area and an inlet area. The discharge area comprises the discharge nozzle for the extinguishing-agent jet; the inlet area is essentially made up of the metallic handle, the hose connection means and the adjustment means together with the manual control device.

The measuring-current transformer is disposed in the insulator section so that no parallel current circuits to the electric current flowing in the extinguishing agent exist which could falsify the current detection and so that it is ensured that the electric current flowing in the extinguishing agent follows a defined current path through the measuring-current transformer.

Owing to this, the measuring-current transformer makes a current signal available at the secondary side which can be evaluated in the evaluation electronics with regard to a possible life-threatening current flowing through the body.

In support and addition to measuring current, detecting a potential difference (electric voltage) between the extinguishing-agent potential and ground potential via an electrode arrangement having a first electrode and a second electrode is intended. The first electrode is disposed in the discharge area in the extinguishing-agent flow; the second electrode is disposed in the inlet area at the metallic handle for detecting ground potential.

In this manner, a potential difference (voltage drop) is measured between the extinguishing-agent potential in the discharge area and the potential at the handle, the potential at the metallic handle corresponding to the ground potential when disregarding the comparatively low body impedance of humans.

This potential difference can provide an additional indication on whether a touch voltage exists which is dangerous to the handling person and can lead to a life-threatening current flowing through the body.

According to the invention, the extinguishing-agent discharge device further comprises a control device having evaluation electronics and having an electromechanical drive element. In the evaluation electronics, the current signal and the potential difference are evaluated for any exceeded thresholds with regard to a possibly endangering body current. The electromechanical drive element controlled by the evaluation electronics, e.g., an electromotor, directly acts on the adjustment means.

In another advantageous embodiment, the evaluation electronics are configured for outputting an alarm signal if the difference in potential exceeds a voltage threshold.

If the potential difference exceeds a pre-settable voltage threshold, an optical and/or an acoustic (pre)alarm can be triggered by the evaluation electronics.

Furthermore, the evaluation electronics are configured for controlling the electromechanical drive element in order to cause an interruption of the extinguishing-agent supply by means of the adjustment means if the electric current flowing in the extinguishing agent exceeds a current threshold.

If an electric current, which flows in the extinguishing agent and could lead to an endangering current flowing through a body, is detected by the evaluation electronics, the electromechanical drive element is controlled by the evaluation electronics in such a manner that the extinguishing-agent supply is immediately interrupted via the adjustment means.

Moreover, the measuring-current transformer is configured for detecting a direct current and an alternating current.

In order to be able to detect the risk from current flowing through bodies caused by direct-voltage sources, the measuring-current transformer is configured for detecting direct current along with detecting alternating currents.

BRIEF DESCRIPTION OF THE DRAWING FIGURES

Further advantageous embodiment features are derived from the following descriptions and the drawings which describe a preferred embodiment of the invention using an example.

Figure 2:
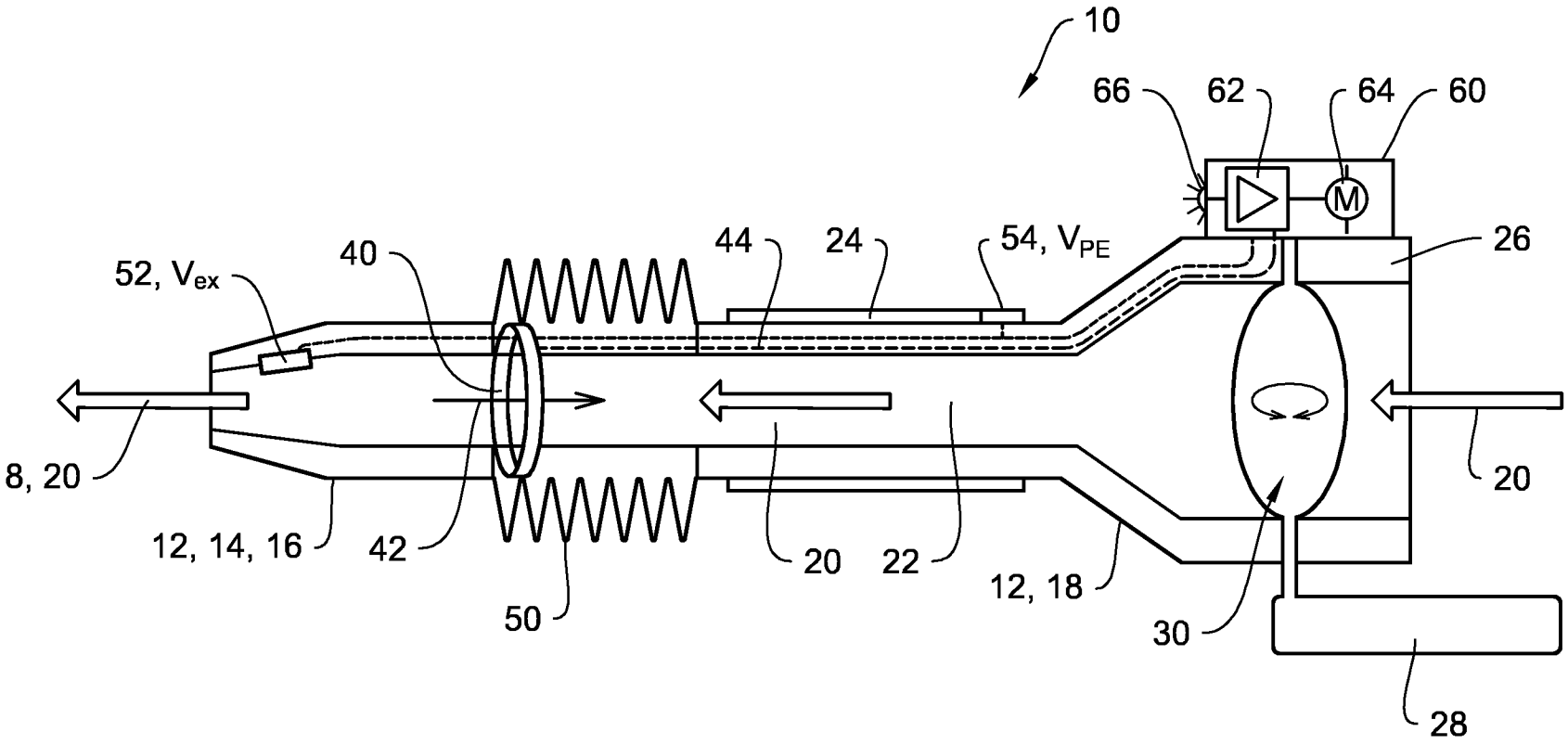

FIG. 1 shows the use of an extinguishing-agent discharge device when fighting fire and FIG. 2 shows an extinguishing-agent discharge device according to the invention in a schematic view.

DETAILED DESCRIPTION

FIG. 1 shows the use of an extinguishing-agent discharge device 10 when fighting a seat of fire 6 of an electric installation 2, e.g., a transformer station or an electric vehicle.

A firefighter (acting person) 4 encircles and actuates extinguishing-agent discharge device 10, an extinguishing agent 20 supplied via extinguishing-agent hose 9 being directed aimed at seat of fire 6 in an extinguishing-agent jet 8. As electric installation 2 is electrically live, a current flow can form in electrically conductible extinguishing agent 20 via an extinguishing-agent jet 8, the current flow continuing as a dangerous current $I_K$ flowing through the body of firefighter 4 standing on ground potential PE.

FIG. 2 shows extinguishing-agent discharge device 10 according to the invention in a schematic view.

Extinguishing-agent discharge device 10 according to the invention comprises a two-part casing 12 which is divided in the longitudinal direction into an (extinguishing-agent) inlet area 18 and a (extinguishing-agent) discharge area 14 via an insulator section 50. Extinguishing agent 20 is guided through a guide channel 22 formed by casing 12 via a hose connection means or hose connection 26, such as a hose clamp, and is discharged at discharge nozzle 16 (fog nozzle having an adapter nozzle). Via, for example, an adjustment means 30 realized as a throttle butterfly or ball valve, the extinguishing-agent supply can be regulated by means of a manual control unit 28, realized as a simple lever, a gate, valve plug, disk, or the like, of the valve of the adjustment means 30 that may be connected to the adjustment means 30 by a stem to be actuated by the adjustment means 30 and regulate the extinguishing agent supply.

Extinguishing-agent discharge device 10 comprises a measuring-current transformer 40 which entirely encloses extinguishing agent 20, which flows in guide channel 22, with its toroid and generates a current signal 44 (secondary current) which is proportional to the electric current 42 (primary current) flowing in extinguishing agent 20.

Extinguishing-agent discharge device 10 further comprises a first electrode 52 which is disposed in the extinguishing-agent flow for detecting an extinguishing-agent potential $V_{ex}$ in discharge area 14. According to the invention, a second electrode 54 is disposed at metallic handle 24 in inlet area 18 for detecting a ground potential $V_{PE}$ as a reference potential.

Current signal 44 of measuring-current transformer 40 and extinguishing-agent potential $V_{ex}$ detected by first electrode 52 and ground potential $V_{PE}$ detected by second electrode 54 are forwarded to evaluation electronics 62 of a control device 60. If potential difference $U_d$ between extinguishing-agent potential $V_{ex}$ and ground potential $V_{PE}$ exceeds a voltage threshold, evaluation electronics 62 will detect this and then optically and/or acoustically output an alarm signal 66 as a result.

Control device 60 further comprises an electromechanical drive element 64 which is controlled by evaluation electronics 62 and causes an interruption of the extinguishing-agent supply via an adjustment means 30 if electric current 42 flowing in extinguishing agent 20 exceeds a preset current threshold. The evaluation electronics 62 may comprise, for example, an electronic circuit (e.g. microcontroller) configured for detecting voltage and current thresholds and for controlling the electromechanical drive element 64.

By means of extinguishing-agent discharge device 10 according to the invention, the measure for effectively fighting fire using an extinguishing agent 20 can be advantageously combined with protective measures for electric safety from electric shock. An increased electric safety is yielded for relief units 4 when putting out a fire at electric installations 2. Moreover, extinguishing-agent discharge device 10 according to the invention enables decreasing the required safety distances and thus more effectively fighting fires.

The invention claimed is:

1. An extinguishing-agent discharge device (10) comprising: a casing (12) having a guide channel (22) through which an extinguishing agent (20) flows, a metallic handle (24), a hose connection (26), an adjustment means (30) for regulating an extinguishing-agent supply using a manual control unit (28) and a discharge nozzle (16), a measuring-current transformer (40) which encloses the extinguishing agent (20) flowing in the guide channel (22) and generates a current signal (44) which is proportional to an electric current (42) flowing in the extinguishing agent (20), an insulator section (50) which divides the casing (12) in the longitudinal direction of the guide channel (22) into a discharge area (14) having the discharge nozzle (16) and an inlet area (18) having the manual control unit (28), the measuring-current transformer (40) being disposed in the insulator section (50), a first electrode (52) which is disposed in the discharge area (14) in the extinguishing-agent flow and serves for detecting an extinguishing-agent potential (Vex), a second electrode (54) which is disposed at the metallic handle (24) for detecting a ground potential (VPE) in the inlet area (18), and a control device (60) having evaluation electronics (62) for evaluating the current signal (44) and for evaluating a potential difference (Ud) occurring between the extinguishing-agent potential (Vex) and ground potential (VPE) and having a drive element (64) which is controlled by the evaluation electronics (62) and acts on the adjustment means (30), wherein the manual control unit comprises at least one of a lever, a gate, a valve plug, and a disk attached to the adjustment means to be actuated by the adjustment means.

2. The extinguishing-agent discharge device (10) according to claim 1, wherein, if the potential difference ($U_d$) exceeds a voltage threshold, the evaluation electronics (62) outputs an alarm signal (66).

3. The extinguishing-agent discharge device (10) according to claim 1, wherein, if the electric current (42) flowing in the extinguishing agent (20) exceeds a current threshold, the evaluation electronics (62) control the electromechanical drive element (64) in order to cause an interruption in the extinguishing-agent supply by means of the adjustment means (30).

4. The extinguishing-agent discharge device (10) according to claim 1, wherein the measuring-current transformer (40) is configured for detecting a direct current and an alternating current.

5. An extinguishing-agent discharge device (10) comprising:

a casing (12) having a guide channel (22) through which an extinguishing agent (20) flows, a metallic handle (24), a hose connection (26), an adjustment means (30) for regulating an extinguishing-agent supply using a manual control unit (28) comprising at least one of a gate, a valve plug, and a disk, and a discharge nozzle (16), a measuring-current transformer (40) which encloses the extinguishing agent (20) flowing in the guide channel (22) and generates a current signal (44) which is proportional to an electric current (42) flowing in the extinguishing agent (20), an insulator section (50) which divides the casing (12) in the longitudinal direction of the guide channel (22) into a discharge area (14) having the discharge nozzle (16) and an inlet area (18) having the manual control unit (28), the measuring-current transformer (40) being disposed in the insulator section (50), a first electrode (52) which is disposed in the discharge area (14) in the extinguishing-agent flow and serves for detecting an extinguishing-agent potential ($V_{ex}$), a second electrode (54) which is disposed at the metallic handle (24) for detecting a ground potential ($V_{PE}$) in the inlet area (18), and a control device (60) having evaluation electronics (62) for evaluating the current signal (44) and for evaluating a potential difference ($U_d$) occurring between the extinguishing-agent potential ($V_{ex}$) and ground potential ($V_{PE}$) and having a drive element (64) which is controlled by the evaluation electronics (62) and acts on the adjustment means (30).

* * * * *